US005137505A

United States Patent [19]

Ishii et al.

[11] Patent Number: 5,137,505

[45] Date of Patent: Aug. 11, 1992

[54] BAG-MAKING APPARATUS WITH ADJUSTABLE FOLD GUIDES

[75] Inventors: Akira Ishii; Yoshiyuki Ishii; Shigehisa Shimizu, all of Kanagawa, Japan

[73] Assignee: Fuji Photo Film Co., Ltd., Minami-Ashigara, Japan

[21] Appl. No.: 700,249

[22] Filed: May 15, 1991

[30] Foreign Application Priority Data

May 16, 1990 [JP] Japan ..... 2-124213

[51] Int. Cl.[5] ..... B31B 1/36

[52] U.S. Cl. ..... 493/248; 493/302; 493/439; 493/440; 493/447; 493/476

[58] Field of Search ..... 493/243, 248, 250, 251, 493/252, 253, 254, 267, 302, 438–440, 443, 446–449, 455, 475, 476, 478, 479

[56] References Cited

U.S. PATENT DOCUMENTS

| | | | |
|---|---|---|---|
| 1,838,704 | 12/1931 | Potdevin | 493/248 |
| 2,428,837 | 10/1943 | Denton . | |
| 2,490,930 | 12/1949 | Thompson . | |
| 2,701,989 | 2/1955 | Hayward et al. | 493/302 |
| 2,899,874 | 8/1959 | Normandin . | |
| 3,391,615 | 7/1968 | Lepisto | 493/248 X |
| 3,408,903 | 11/1968 | Lepisto et al. | 493/248 X |
| 3,566,756 | 3/1971 | Schmid et al. | 493/439 |
| 4,047,711 | 9/1977 | Gregoire et al. | 493/248 |
| 4,421,501 | 12/1983 | Scheffer | 493/439 |
| 4,650,406 | 3/1987 | Peters | 493/439 X |
| 4,764,161 | 8/1988 | Davidson et al. | 493/248 |
| 4,871,347 | 10/1989 | Brinkmeier | 493/248 X |

FOREIGN PATENT DOCUMENTS

| | | |
|---|---|---|
| 551028 | 9/1956 | Belgium . |
| 689549 | 3/1940 | Fed. Rep. of Germany . |
| 23209 | 7/1983 | Fed. Rep. of Germany . |
| 691943 | 7/1951 | United Kingdom . |
| 676047 | 7/1952 | United Kingdom . |
| 780468 | 7/1957 | United Kingdom . |
| 2144368A | 3/1985 | United Kingdom . |

*Primary Examiner*—Bruce M. Kisliuk
*Assistant Examiner*—John A. Marlott
*Attorney, Agent, or Firm*—Burns, Doane, Swecker & Mathis

[57] ABSTRACT

A bag-making apparatus which comprises a support table carrying a bag material which is put thereon, a pair of side guides being provided above the support table, being movable in the direction perpendicular to the traveling direction of the bag material and controlling both side of the bag material, a pair of top guides being movable in the direction perpendicular to the traveling direction of the bag material together with the side guides, having the space therebetween gradually narrower from the approach side to the leaving side of the bag material, and controlling the front face of the bag material made tubular, and forming rollers being disposed on the approach side of the bag material from the top guides, being movable in the direction perpendicular to the traveling direction of the bag material, and pressing the bag material onto the support table. The bag-making apparatus can change the bag width rapidly and accurately in a simple action without stopping the travel of the bag material resulting to shorter the working time and to improve productive efficiency. The loss of the bag material due to the bag width changes can be reduced.

3 Claims, 6 Drawing Sheets

BAG-MAKING APPARATUS WITH ADJUSTABLE FOLD GUIDES

BACKGROUND OF THE INVENTION

This invention relates to a bag-making apparatus for forming a bag while the bag material travels continuously.

A conventional bag-making apparatus is shown in FIGS. 9 to 11. The bag-making apparatus 40 comprises a pair of forming rollers 41 which are arranged so as to contact the upper surface of the bag material 44, a dedicated forming plate 42 meeting the bag width of the tubular bag material, pressing rollers 43 disposed on the forming plate 42 with prescribed intervals, guide plates 45 arranged in the traveling direction of the bag material 44 together with the pressing rollers 43 and conveying rollers 46. The forming rollers 41 movable in the cross direction of the bag material 44 move according to the bag width, and crease lines at a distance corresponding to the bag width. The forming plate 42 contact the upper surface of the bag material 44, and both sides of the bag material 44 are folded. Thus, the bag material 44 is lapped around the forming plate 42, and made tubular. The pressing rollers 43 press both side edges of the folded bag material upon the forming plate 42. The guide plates 45 guide the bag material 44 before and after pressing by the pressing rollers 43. The conveying rollers 46 convey the bag material which has been formed tubular.

When the bag material was made tubular using the above apparatus 40, first, the upper surface of the bag material 44 was pressed by the forming roller 41, and both side portions were folded upward obliquely. Then, the forming plate 42 was applied along the crease line folded by the forming rollers 41, and both folded side portions were guided by the guide plates 45 so that they came near together in a state that the bottom and both side edges of the forming plate 42 contacted the bag material 44. The both folded side portions were pressed downwardly by the pressing rollers 43 to form the bag material tubular around the forming plate 42. When the bag width was changed, the traveling of the bag material was stopped. Then, the guide plates 45, the pressing rollers 43 and conveying rollers 46 were transferred to the outside of the apparatus temporarily, and the forming rollers 41 were moved in the cross direction so that they had a distance corresponding to the bag width. Subsequently, the tubular bag material surrounding the forming plate 42 was opened or removed, and the forming plate 42 was changed for another dedicated forming plate corresponding to the prescribed bag width. Then, the bag material was lapped around the new forming plate, and the guide plates 45 and the pressing rollers 43 were adjusted with regard to their positions in the traveling direction of the bag material, pressing force, etc., with conveying the bag material and making it tubular.

A conventional bag-making apparatus for making gusset bag is shown in FIGS. 12 to 14. The bag-making apparatus 47 comprises a forming plate 49 of which the approach side is bent to form an inclined face, guide bars 50 disposed on both sides in the cross direction of the forming plate 49, pressing rollers 51 disposed on the forming plate 49 in the traveling direction of the bag material 48, creasing rollers 52 disposed on both sides of the forming plate 49 perpendicular to the pressing rollers 51, and nip rolls 53 for nipping the bag material 48 formed tubular. The forming plate 49 is composed of two plates **49*a*, 49*a* disposed horizontally in parallel and a Joining member 49*b* Joining them at the central part. The forming plate 49 is used for making the bag material tubular by lapping the bag material around it, and has a dedicated size for each gusset bag. The guide bars 50 fold the bag material 48 so as to lap the forming plate 49, and are formed in L-shape. The pressing rollers 51 press the bag material formed tubular on the forming plate 49. The creasing rollers 52 form a crease by pressing on the central portion of each side of the bag material 48 formed tubular by the forming plate 49 and the guide bars 50**.

When the bag material was made tubular using the above apparatus 47, both side portions of the bag material 48 were folded upward by the guide bars 50 in a state that the upper surface of the bag material 48 contacted the bottom face of the forming plate 49. The folded portions were pressed by the pressing roller 51 to form the bag material 48 tubular, while the creasing rollers 52 were pressed on the central portion of each side of the bag material 48 to form gusset. Thereafter, the bag material was pressed by the nip rollers 53, and a gusset type tube was completed. When the bag width was changed, the traveling of the bag material was stopped. Then, the guide bars 53, the pressing rollers 51 and the creasing rollers 52 were transferred to the outside of the apparatus temporarily, and the tubular bag material was opened or removed. The forming pate 49 was changed for another dedicated forming plate corresponding to the prescribed bag width. Then, the bag material 48 was lapped around the new forming plate, and the guide bars 50, the pressing rollers 51 and the creasing rollers 52 were returned to the prescribed position. The traveling of the bag material 48 was resumed, and the guide bars 50, the pressing rollers 51 and the creasing rollers 52 were adjusted with regard to their positions, pressing force, etc. with confirming the state of the tubular bag material (Japanese Patent KOKAI No. 55-103946).

As mentioned above, in the case of the conventional bag-making apparatuses, when the bag width was changed, the traveling of the bag material must be once stopped, and then, the forming plate was changed for another dedicated forming plate corresponding to the prescribed bag width. As a result, the working time was increased, and the productive efficiency was lowered. In order to change the forming plate, the tubular bag material surrounding the forming plate must be opened or removed also resulting to increase the working time and to lower the productive efficiency. After the forming plate was changed, the traveling of the bag material must be resumed in the state that the guide plates or bars, the pressing rollers, etc. were temporarily positioned. The optimum positions of them must be determined by adjusting the conditions with confirming the state of the tubular bag material, such as its size. Therefore, a considerable time was necessary until the optimum positions were determined resulting that the state of the tubular bag material became good. As a result, the productive efficiency was lowered due to the increase of the loss of the bag material, as well as the working time was increased.

SUMMARY OF THE INVENTION

An object of the invention is to provide a bag-making apparatus capable of changing the bag width without stopping the travel of a bag material.

Another object of the invention is to provide a bag-making apparatus capable of shortening working time and decreasing bag material loss.

The present invention provides a bag-making apparatus which has achieved the above object, comprising a support table carrying a bag material which is put thereon, a pair of side guides being provided above the support table, being movable in the direction perpendicular to the traveling direction of the bag material and controlling both side of the bag material, a pair of top guides being movable in the direction perpendicular to the traveling direction of the bag material together with the side guides, having the space therebetween gradually narrower from the approach side to the leaving side of the bag material, and controlling the front face of the bag material made tubular, and forming rollers being disposed on the approach side of the bag material from the top guides, being movable in the direction perpendicular to the traveling direction of the bag material, and pressing the bag material onto the support table.

DETAILED DESCRIPTION OF THE INVENTION

Figure 1:
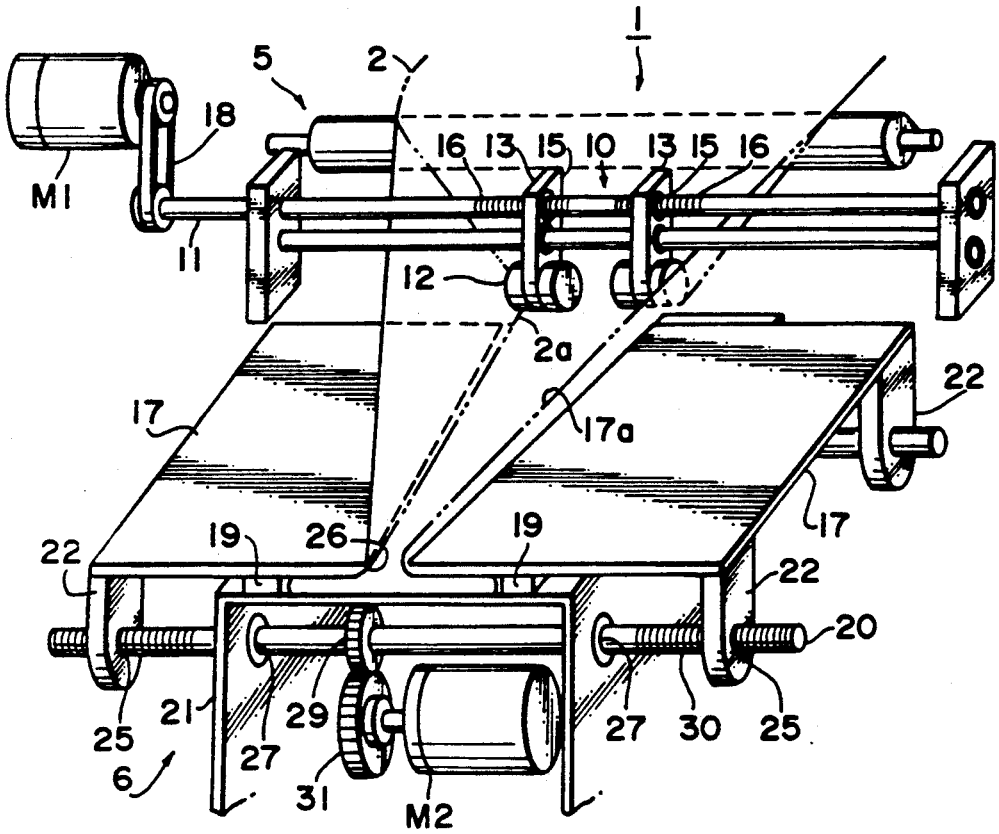
FIG. 1 is a perspective view of a bag-making apparatus embodying the invention.

The support table is a member on which the bag material is put to form the back side of bag material formed tubular, and a conventional table can be used as the support table.

The pair of the side guides is movable on the support table in the direction perpendicular to the traveling direction of the bag material, and controls both sides of the bag material. That is, the bag width of the bag material made tubular can be arbitrarily set by moving the side guides in the direction perpendicular to the traveling direction of the bag material.

The pair of the top guides is movable in the direction perpendicular to the traveling direction of the bag material together with the pair of the side guides, and the space between both top guides is made gradually narrower from the approach side to the leaving side of the bag material. In order to move each top guide together with the side guide, the side guide may be fixed to the top guide. Alternatively, the top guide may be provided separate from the side guide and moved by another mechanism. The top guides control the front side, i.e. form the front side, of the tubular bag material.

The forming roller is provided on the approach side of the bag material from the pair of the top guides, and presses the bag material on the support table. Therefore, the forming roller may be any member capable of pressing the traveling bag material with slipping.

In the bag-making apparatus of the invention, the support table carries the bag material, and forms the back side of the bag material formed tubular. The side guides control to form both sides of the bag material. Moreover, the side guides move in the direction perpendicular to the traveling direction of the bag material, and set the bag width arbitrarily. The top guides gradually fold both sides of the bag material during delivering it from the approach side to the leaving side, and form the front side of the tubular bag material. The forming rollers from the crease lines for folding both sides of the bag material.

In the above apparatus, the bag material continuously travels, and is folded by contacting the forming rollers. Subsequently, the forming guides are contacted with the reverse face of the bag material not contacting the forming rollers from the cross direction, and further fold both sides of the bag material. At that time, projections are contacted with the bag material from the cross direction to prevent the bag material from expanding, and the bag material is nipped by a support member contacting the reverse face of the bag material not contacting the forming rollers to prevent the bag material from expanding in the direction opposite to the forming rollers. When the bag width is changed, the forming rollers and the forming guides are interlocked and moved in the cross direction of the bag material while the bag material continuously travels. Then, the contact position of the bag material with the forming rollers and the forming guides vary, and the bag width is changed. Thus, the bag width can be changed rapidly and accurately without stop by a simple operation to move the forming rollers and the forming guides in the cross direction of the bag material.

In the apparatus of the invention, the bag material is made tubular by back Joining. The joining means may be conventional, such as the utilization of various adhesives, melt adhesion or the like, and necessary apparatuses therefore may be incorporated into or provide after the apparatus of the invention. The apparatuses include an adhesive coater, a heat sealer, and the like.

EXAMPLE

EXAMPLE 1

An example of the bag making apparatus of the invention is shown in FIGS. 1 to 4. The bag-making apparatus 1 is composed of a carrying part 3 carrying the bag material 2 continuously, a folding part 5 forming 2 crease lines 2*a* on the bag material 2 along the traveling direction, and a tube-forming part 6 forming the bag material 2 into a tube by folding at the crease lines 2*a*.

Figure 3:
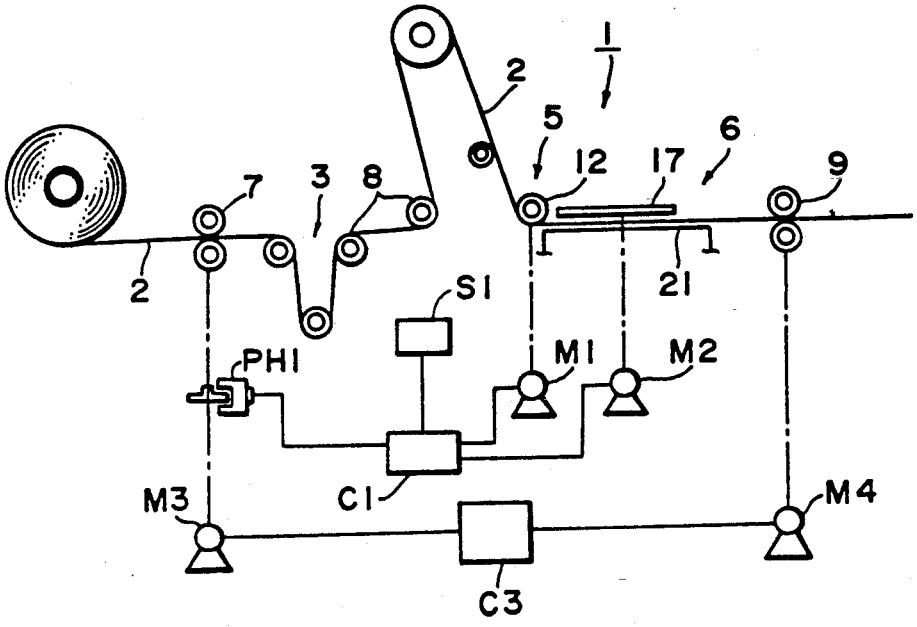
FIG. 3 is a schematic illustration thereof.

The carrying part 3 is, as shown in FIG. 3, composed of a pair of approach side nip rollers 7, a pair of leaving side nip rollers 9, many free rotation rollers provided therebetween, and motors M3, M4. The approach side nip rollers 7 are driven by the motor M3 regulated by a controller C3, and extend to carry the bag material 2 from the coil thereof. The leaving side nip rollers 9 are driven by the motor M4 also regulated by the controller C3, and carry the bag material formed tubular. The free rotation rollers 8 are rotatably supported, and change the traveling direction of the bag material 2.

The folding part 5 is, as shown in FIG. 1, composed of a forming roller part 10, a roller support shaft 11 supporting the forming roller part 10 movably in the cross direction, and a motor M1 revolving the roller support shaft 11. The forming roller part 10 is composed of two rollers 12 contacting the bag material to form crease lines 2*a* thereon and two support plates 13 supporting the roller 12 rotatably, and a female screw 15 is formed at the upper part of the support plate 13. The roller support shaft 11 is provided above the bag material in the cross direction, and penetrates two support plates 13. Two male screws 16 are formed at almost the same distance from the center threaded in the opposite direction to each other, and the female screw 15 of each support plate 13 is fitted onto the male screw 16 of the roller support shaft 11. Thus, two support plates move in the cross direction by the rotation of the roller support shaft 11, and the distance between two support plates 13 varies. The roller support shaft 11 is connected with the motor M1 through an endless belt 18, and revolved by the rotation of the motor M1.

Figure 2:
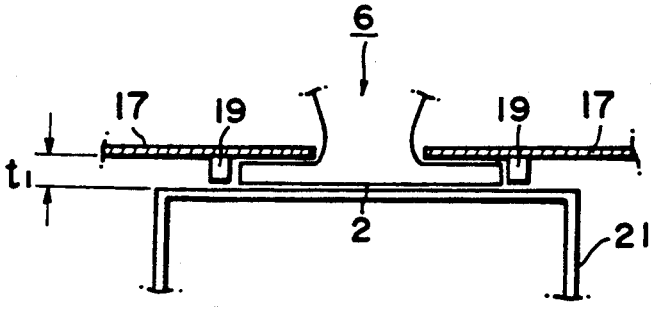
FIG. 2 is a partially sectional view thereof.

The tube-forming part 6 is, as shown in FIGS. 1 and 2, composed of a support table 21 carrying the bag material 2 which is put thereon and being fixed to a frame and each one pair of top guides 17 and side guides 19 movable in the cross direction. A guide support shaft 20 rotatably penetrates the support table 21. Both end portions of the guide support shaft 20 are threaded to form male screws 30 in the opposite direction to each other. A follower gear 29 is fixed at almost the center of the shaft 20. The top guides 17 are formed so that their width is gradually large from the approach side to the leaving side, i.e. the space between the pair of the top guides 17 gradually narrow. The side guide 19 is fixed to the underside of each top guide 17 parallel to the traveling direction. The position of the approach side end of the side guide 19 is almost the same as the end of the top guide 17, and the approach side end is formed in circular arc-shaped in order to facilitate traveling and to prevent damage of the bag material. Bracket 22 is projected downward from the outside end of each top guide 17. A female screw 25 is formed on each bracket 22 in the opposite direction to each other, and the male screw 30 of the guide support shaft 20 is fitted in each female screw 25. The follower gear 29 engages a driving gear 31 of a motor M2.

As shown in FIG. 3, the motors M1 and M2 are connected with a controller C1, and the controller C1 regulates the motors M1 and M2 by the signals sent from an operation panel S1 and a sensor PH1. When the pulse member due to the position to start a width change of the bag material which is previously set coincides with the pulse number due to the length of the carried bag material sent from the sensor PH1, the motors M1 and M2 work synchronously. Thereafter, when the pulse number due to the working time of the motors M1 and M2 coincides with the pulse number due to the bag width previously set in the operation panel S1, the motors M1 and M2 are stopped. The operation panel S1 is operated by an operator, and set the bag width. The sensor PH1 detects the revolution number of the approach side nip roller 7 to determine the length of the carried bag material.

When the bag material is made tubular using the above bag-making apparatus, as shown in FIG. 3, the bag material 2 is extended from a coil thereof by the approach side nip rollers 7. The extended bag material 2 is delivered to the folding part 5 and the tube-forming part 6 by the approach side nip rollers 7, and the bag material 2 formed tubular is drawn by the leaving side nip rollers 9. As shown in FIG. 1, the bag material 2 delivered to the folding part is pressed onto the support table 21 by the rollers 12 to form crease lines 2*a*. The bag material 2 further travels while it is contacted with the upper surface of the support table 21. At that time, since both side ends of the bag material 2 are controlled by the side guides 19, both sides of the bag material 2 are folded to be doubled by the side guides as shown in FIG. 2. Thus, the bag width is determined. The folded parts of the bag material 2 are controlled by the top guides 17, and the width of the folded parts are gradually increased with traveling of the bag material 2 by the control of the top guides 17. Lastly, both side edges are overlapped. The bag material 2 thus formed tubular is delivered to the following adhering and cutting processes (not illustrated).

When the bag width is changed wider, the operator sets the position to start a width change of the bag material into the controller C1 by a pulse number, and sets the bag width by the operation panel S1. Then, the sensor PH1 counts the carried length of the bag material 2, and the controller C2 converts the pulse based upon the signal of the sensor PH1. When the traveling bag material 2 reaches the position to start a width change of the bag material, the pulse number due to the carried length of the bag material 2 detected by the sensor PH1 coincides with the pulse number due to the position to start a width change of the bag material previously set in the controller C1, and the controller C1 works the motors M1 and M2 synchronously. The rotation of the motor M1 is transmitted to the roller support shaft 11 through the endless belt 18, and the rotation of the motor M2 is transmitted to the guide support shaft 20 through the driving gear 31 and the follower gear 29. Then, a screw action occurs between the male screws 16, 16 of the roller support shaft 11 and the female screws 25, 25 of the support plates 13, 13, the rollers 12, 12 move outward respectively. Simultaneously, another screw action occurs between the male screws 30, 30 of the guide support shaft 20 and the female screws 25, 25 of the brackets 22, 22 by the rotation of the shaft 20, and the top guides 17, 17 move outward respectively together with the side guides 19, 19. Thus, the contact position of the bag material 2 with the rollers 12, 12, the top guides 17, 17 and the side guides 19, 19 moves outward in the cross direction of the bag material to expand the bag width.

When the bag width is changed narrower, the motors M1 and M2 are worked in the opposite direction to the above case that the bag width is changed wider. As a result, the roller support shaft 11 and the guide support shaft 20 rotate reversely, and the rollers 12, 12 and the forming guides composed of the top guides 17, 17 and the side guides 19, 19 move inward. Thus, the contact position of the bag material 2 with the rollers 12, 12, the top guides 17, 17 and the side guides 19, 19 moves inward in the cross direction of the bag material to narrow the bag width.

The traveling speed of the bag material through changing the bag width is preferably lower in view of less trouble as well as the reduction of the bag material loss, and to keep the relation of the traveling speed of the bag material greater than the moving speed of the rollers, the top guides and the side guides is preferred. A preferred speed ratio is 15–30:1 with due regard to the occurrence of crinkling and folding of the bag material during moving the rollers, the top guides and the side guides.

Figure 4:
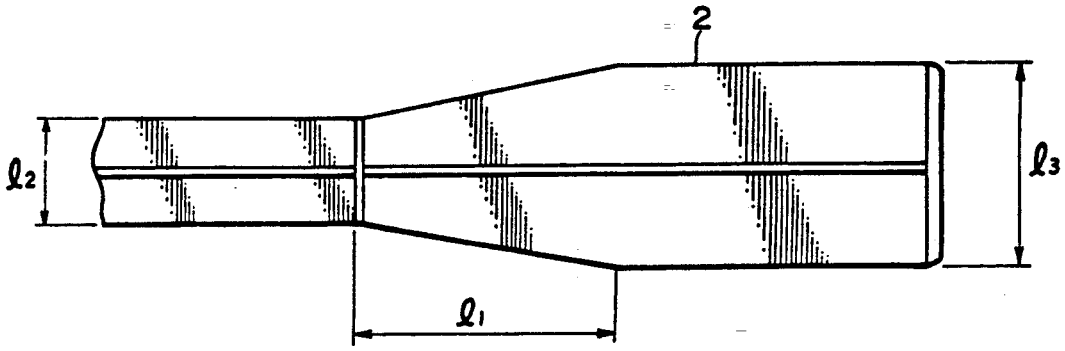
FIG. 4 is a plan view indicating the width change of a bag material when the bag width is changed.

A bag material was formed tubular having a bag width $l_2=150$ mm by using the above bag-making apparatus 1, while the bag material 2 was continuously carried. Then, the bag width was changed to $l_3=180$ mm. The ratio of the traveling speed of the bag material to the moving speed of the rollers, the top guides and the side guides was set 15–30:1. As s result, as shown in FIG. 4, two tubular bag materials different in the bag width were prepared with stable quality and accurate size without the interruption of the traveling of the bag material and the adjustment after the change of the bag width. The loss $l_1$ of the bag material 2 was only several meters.

EXAMPLE 2

Another example of the bag-making apparatus of the invention is shown in FIGS. 5–8. The members indicated by the same number or symbol are the same as Example 1. This bag-making apparatus has a gusset-forming part 35 forming gusset portion into the bag material 2.

Figure 5:
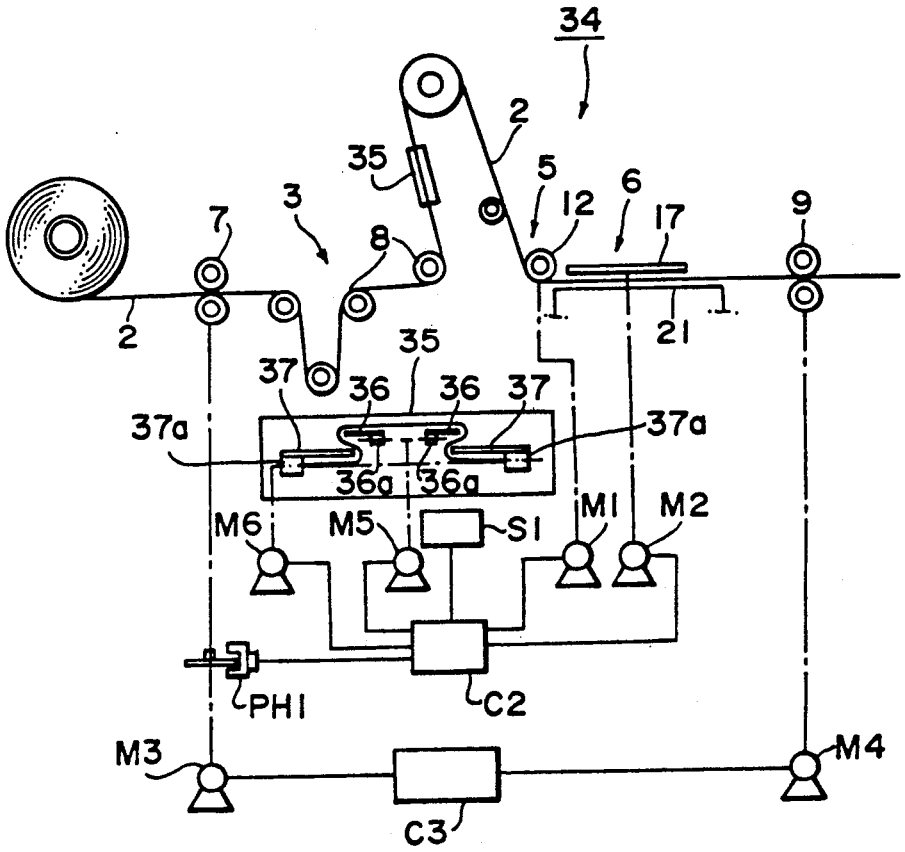
FIG. 5 is a schematic illustration of another bag-making apparatus embodying the invention.

The gusset-forming part 35 is, as shown in FIG. 5, disposed between the approach side nip rollers 7 of the carrying part 3 and the rollers 12 of the folding part 5, and composed of inside forming plates 36, outside forming plates 37 and motors M5, M6. The inside forming plates 36 have a female screw, and an inside screw shaft 36*a* threaded to form male screws symmetrically is fitted into each female screw of the inside forming plate 36. Therefore, the inside forming plates 36 are movable in the cross direction of the bag material by the screw action, and the distance between them can vary. The outside forming plates 37 are disposed downward and outward the inside forming plates 36. The outside forming plates 37 also have a female screw, and an outside screw shaft 37*a* threaded to form male screws symmetrically is fitted into each female screw of the outside forming plate 37. Therefore, the outside forming plates 37 are also movable in the cross direction of the bag material by the screw action, and the distance between them can vary. The motor M5 is connected with a controller C2 and the inside screw shaft 36*a*, and revolves the shaft 36*a* under the control of the controller C2. The motor M4 is connected with the controller C2 and the outside screw shaft 37*a*, and revolves the shaft 37*a* under the control of the controller C2.

When the bag material is made tubular with gussets using the above bag making apparatus, as shown in FIG. 5, the bag material 2 is extended from a coil thereof by the approach side nip rollers 7. The extended bag material 2 is delivered to the gusset-forming part 35. The bag material 2 is folded to form gussets by passing between the inside forming plate 36 and the outside forming plate 37. Then, the bag material 2 is delivered to the folding part 5 and the tube-forming part 6, and is made tubular, as described in Example 1.

When the bag width is changed wider, the operator sets the position to start the gusset width change and the position to start the width change of the bag material into the controller C2 by a pulse number, and sets the bag width by the operation panel S1. Then, the sensor PH1 counts the carried length of the bag material 2, and the controller C2 converts the pulse based upon the signal of the sensor PH1. When the traveling bag material 2 reaches the position to start the gusset width change of the bag material, the pulse number due to the carried length of the bag material 2 detected by the sensor PH1 coincides with the pulse number due to the position to start the gusset width change of the bag material previously set in the controller C2, and the controller C1 works the motors M5 and M6 synchronously. The inside screw shaft 36*a* is revolved by the motor M5, and the inside forming plates 36, 36 move outward by the screw action. Simultaneously, the outside screw shaft 37*a* is revolved by the motor M6, and the outside forming plates 37, 37 move outward by the screw action. Thus, the contact position of the bag material 2 with the inside forming plates 36, 36 and the outside forming plates 37, 37 moves outward in the cross direction of the bag material to expand the gusset width.

Subsequently, when the traveling bag material 2 reaches the position to start the width change of the bag material, the pulse number due to the carried length of the bag material 2 detected by the sensor PH1 coincides with the pulse number due to the position to start the width change of the bag material previously set in the controller C1, and the controller C1 works the motors M1 and M2 synchronously. Thereby, the contact position of the bag material 2 with the rollers 12, 12, the top guides 17, 17 and the side guides 19, 19 moves outward in the cross direction of the bag material to expand the bag width.

Figure 6:
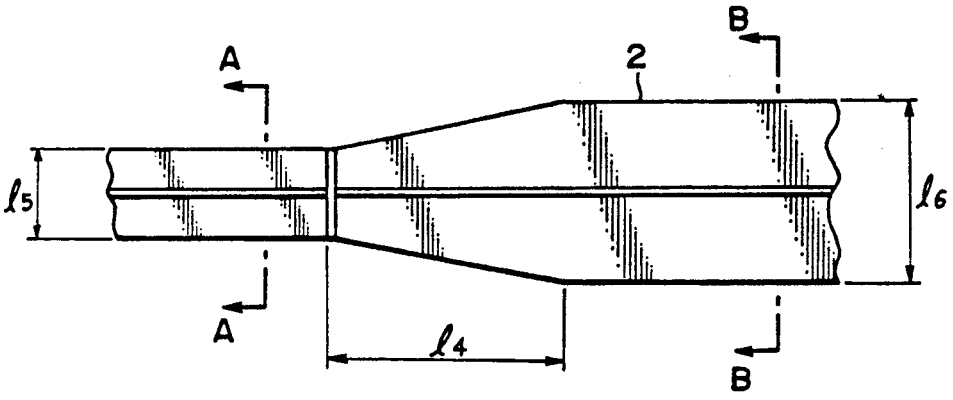
FIG. 6 is a plan view indicating the width change of a bag material when the bag width is changed.
Figure 7:
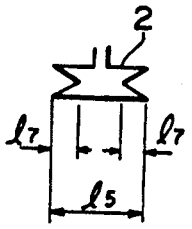
FIG. 7 is a cross sectional view taken on line A—A of FIG. 6.
Figure 8:
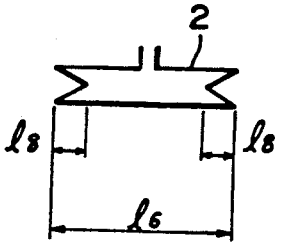
FIG. 8 is a cross-sectional view taken on line B—B of FIG. 6.
Figure 9:
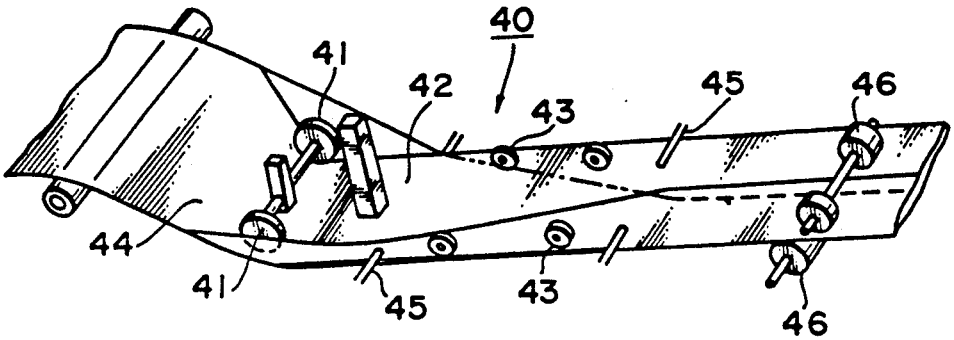
FIG. 9 PRIOR ART
FIG. 9 is a partially perspective view of a conventional bag-making apparatus.
Figure 10:
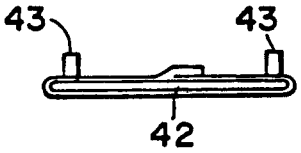
FIG. 10 PRIOR ART
FIG. 10 is a sectional view at the tube-forming portion thereof.
Figure 11:
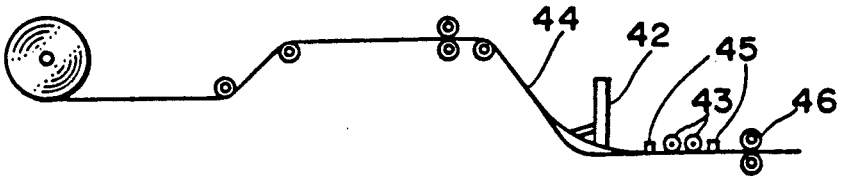
FIG. 11 PRIOR ART
FIG. 11 is a schematic illustration thereof.
Figure 12:
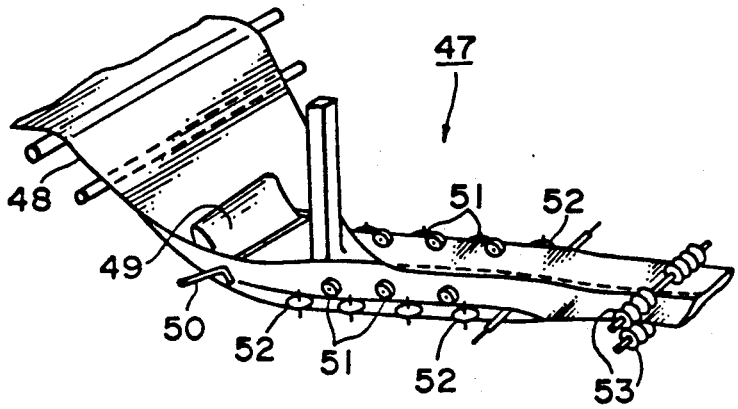
FIG. 12 PRIOR ART
FIG. 12 is a partially perspective view of another conventional bag-making apparatus, FIG. 13 ia a sectional view at the tube-forming portion thereof.
Figure 13:
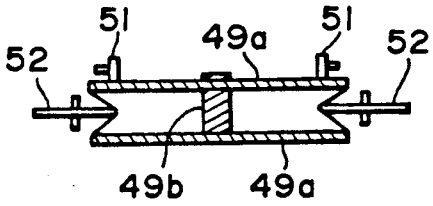
FIG. 13 PRIOR ART
Figure 14:
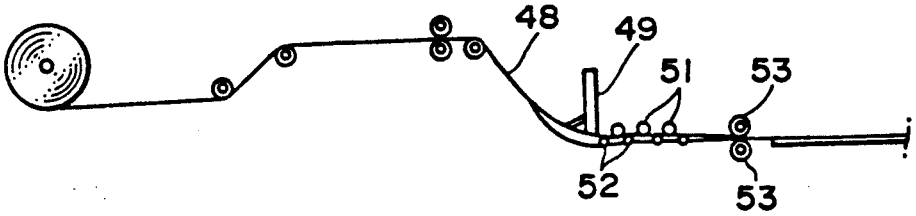
FIG. 14 PRIOR ART
FIG. 14 is a schematic illustration thereof.

A bag material was formed tubular with gussets having a bag width $l_5=150$ mm and a gusset depth $l_7=30$ mm by using the above bag-making apparatus 34, while the bag material 2 was continuously carried. Then, the width conditions were changed to $l_6=180$ mm and $L_8=30$ mm. The ratio of the traveling speed of the bag material 2 to the moving speed of the rollers 12, the top guides 17 and the side guides 19 was set 15–30:1. As a result, as shown in FIGS. 6–8, two tubular bag materials different in the bag width were prepared with stable quality and accurate size without the interruption of the traveling of the bag material and the adjustment after the change of the bag width. The loss $l_4$ of the bag material 2 was only several meters.

We claim:

1. A bag-making apparatus for making bags of different sizes comprising a support table for supporting bag material put thereon, a pair of side guides being provided above the support table and movable in a direction perpendicular to the traveling direction of the bag material so as to control both sides of the bag material, said side guides being movable to predetermined positions with each position corresponding to a different size bag, a pair of top guides movable in the direction perpendicular to the traveling direction of the bag material together with the side guides, the side guides having a space therebetween which gradually narrows in the travelling direction of the bag material, forming rollers positioned on a side of the apparatus to which the bag material approaches the top guides, said forming rollers movable in the direction perpendicular to the traveling direction of the bag material so as to press the bag material onto the support table.

2. The bag-making apparatus of claim 1 which further comprises a gusset-forming part comprising a pair of inside forming plates movable in the direction perpendicular to the traveling direction of the bag material and a pair of outside forming plates movable in the direction perpendicular to the traveling direction of the bag material.

3. The bag-making apparatus of claim 1 wherein said side guides and top guides are moved by a screw action.

* * * * *